US012338409B2

(12) United States Patent
Nelson et al.

(10) Patent No.: US 12,338,409 B2
(45) Date of Patent: Jun. 24, 2025

(54) LUBRICATING OILS WITH VISCOSITY INDEX IMPROVER CONCENTRATES

(71) Applicant: Kraton Chemical, LLC, Jacksonville, FL (US)

(72) Inventors: Lloyd A. Nelson, Savannah, GA (US); Charles D. Moses, Savannah, GA (US)

(73) Assignee: Kraton Chemical, LLC, Jacksonville, FL (US)

( * ) Notice: Subject to any disclaimer, the term of this patent is extended or adjusted under 35 U.S.C. 154(b) by 0 days.

(21) Appl. No.: 18/608,762

(22) Filed: Mar. 18, 2024

(65) Prior Publication Data

US 2024/0218281 A1 Jul. 4, 2024

Related U.S. Application Data

(63) Continuation-in-part of application No. 18/468,915, filed on Sep. 18, 2023, now Pat. No. 12,139,687.

(60) Provisional application No. 63/583,383, filed on Sep. 18, 2023, provisional application No. 63/516,709, filed on Jul. 31, 2023, provisional application No. 63/503,478, filed on May 21, 2023, provisional application No. 63/376,008, filed on Sep. 16, 2022.

(51) Int. Cl.

| | |
|---|---|
| ***C10M 143/02*** | (2006.01) |
| ***C10M 129/58*** | (2006.01) |
| ***C10M 129/62*** | (2006.01) |
| ***C10M 143/04*** | (2006.01) |
| ***C10M 143/10*** | (2006.01) |
| ***C10M 143/12*** | (2006.01) |
| ***C10M 169/04*** | (2006.01) |
| *C10N 20/00* | (2006.01) |
| *C10N 30/02* | (2006.01) |
| *C10N 40/08* | (2006.01) |
| *C10N 40/25* | (2006.01) |
| *C10N 70/00* | (2006.01) |

(52) U.S. Cl.

CPC ..... *C10M 143/02* (2013.01); *C10M 129/58* (2013.01); *C10M 129/62* (2013.01); *C10M 143/04* (2013.01); *C10M 143/10* (2013.01); *C10M 143/12* (2013.01); *C10M 169/04* (2013.01); *C10M 2205/022* (2013.01); *C10M 2205/024* (2013.01); *C10M 2205/04* (2013.01); *C10M 2205/06* (2013.01); *C10M 2207/16* (2013.01); *C10M 2207/20* (2013.01); *C10N 2020/073* (2020.05); *C10N 2030/02* (2013.01); *C10N 2040/08* (2013.01); *C10N 2040/25* (2013.01); *C10N 2070/02* (2020.05)

(58) Field of Classification Search

CPC ..... C10M 143/02; C10M 129/58; C10M 129/62; C10M 143/04; C10M 143/10; C10M 143/12; C10M 169/04; C10M 2205/022; C10M 2205/024; C10M 2205/04; C10M 2205/06; C10M 2207/16; C10M 2207/20; C10N 2020/073; C10N 2030/02; C10N 2040/08; C10N 2040/25; C10N 2070/02; C10N 2020/02

USPC ..... 508/449, 591

See application file for complete search history.

(56) References Cited

U.S. PATENT DOCUMENTS 2,221,953 A * 11/1940 Read ..... C10M 1/08 585/254

6,592,639 B2 7/2003 Bernasconi et al.

* cited by examiner

*Primary Examiner* — Prem C Singh
*Assistant Examiner* — Francis C Campanell

(57) ABSTRACT

The disclosure relates to viscosity improver concentrates comprising a bio-based liquid decarboxylated rosin acid as a solubilizer, and a viscosity index improver. The viscosity improver concentrate is used in lubricating oil compositions comprising base oil and optional additives. The decarboxylated rosin acid component has at least one or more of: one or more C═C groups, and 40-100 wt. % of tricyclic compounds having 18-20 carbon atoms; a sum of tricyclic compounds as aromatic and cycloaliphatic of 50-100 wt. %, based on total weight of the decarboxylated rosin acid; and an amount of cycloaliphatic compounds of 15-100 wt. %, based on total weight of the decarboxylated rosin acid. The viscosity improver concentrates comprising the solubilizer have comparable properties, including compatibility, kinematic viscosity, and viscosity index, to other commonly used fossil based solubilizers.

17 Claims, No Drawings

LUBRICATING OILS WITH VISCOSITY INDEX IMPROVER CONCENTRATES

RELATED APPLICATIONS

This application is a continuation-in-part of U.S. patent application Ser. No. 18/468,915, filed on Sep. 18, 2023, which claims the benefit of U.S. Provisional Application No. 63/376,008, filed on Sep. 16, 2022, and U.S. Provisional Application No. 63/516,709, filed on Jul. 31, 2023, all incorporated herein by reference in their entirety. This application also claims priority to U.S. Provisional Application No. 63/503,478, filed on May 21, 2023, and U.S. Provisional Application No. 63/583,383, filed on Sep. 18, 2023, both incorporated herein by reference in their entirety.

FIELD

The disclosure relates to lubricating oils with viscosity index improver concentrates comprising a bio-based liquid decarboxylated rosin acid as a solubilizer.

BACKGROUND

Lubricating oils contain various components including base oils, solubilizers, and additives that enhance the performance of the lubricant. The additives can be formulated into packages, e.g., concentrates, for specified end-use applications such as automotive engine crankcase lubricants, hydraulic fluids, and gear oils. The concentrates, such as viscosity modifier concentrates and additive package concentrates, include a solubilizer and one or more additives.

Viscosity modifiers, also known as viscosity index improvers or viscosity improvers, are additives that improve the viscometric performance of an oil by decreasing the base oil viscosity temperature dependency, reducing lubricating oil resistance to cold engine starting, and reducing the viscosity of the oils in response to shear. The viscosity modifiers are typically polymers, such as olefin copolymers, polymethacrylates, alkenyl arene/hydrogenated diene block and star copolymers and hydrogenated diene linear and star polymers.

Viscosity modifiers are commonly provided to lubricating oil formulators as a concentrate in which the viscosity modifier is mixed with a solubilizer to allow for easier dissolution of the viscosity modifier in the base oil.

Solubilizers tend to be a minor component in a finished lubricant oil formulation. For example, a lubricant oil (e.g., engine oil, hydraulic oil) typically contains many additives. The solubilizer is generally in the finished lubricant formulation as a "carrier fluid" to reduce the high viscosity additive(s) to a low enough viscosity to enable blending the additives as liquids. The solubilizer also helps to solubilize the additives and to keep the additives oxidatively stable. Although much effort has been made to select the proper base oil for lubricants, little attention has been given to the selection of the solubilizer used in viscosity modifier concentrates as well as solubilizers used in additive packages.

There is a need for a biobased liquid solubilizer that is compatible with a wide range of viscosity index improvers without negatively impacting performance of lubricating oils.

SUMMARY OF THE INVENTION

In an aspect, a viscosity modifier concentrate is disclosed. The viscosity modifier concentrate comprises 0.01-10 wt. % of a viscosity index improver, 90-99.9 wt. % of a solubilizer comprising a decarboxylated rosin acid, and 0.0 to 35.0 wt. % additives. The decarboxylated rosin acid has at least one of: one or more C═C groups, and 40-100 wt. % of tricyclic compounds having 18-20 carbon atoms; a sum of tricyclic compounds as aromatic and cycloaliphatic of 50-100 wt. %, based on total weight of the decarboxylated rosin acid; and an amount of cycloaliphatic compounds of 15-100 wt. %, based on total weight of the decarboxylated rosin acid. The decarboxylated rosin acid solubilizes the viscosity index improver in less than 3 hours at a temperature of 120° C.

In an aspect, a method of forming a viscosity modifier concentrate is disclosed. The method comprises providing 0.01-10 wt. % of a viscosity index improver, providing 90-99.9 wt. % of a solubilizer comprising a decarboxylated rosin acid, providing 0-35 wt. % of additives, and contacting the viscosity modifier and the solubilizer to form the viscosity modifier concentrate. The decarboxylated rosin acid has at least one of: one or more C═C groups, and 40-100 wt. % of tricyclic compounds having 18-20 carbon atoms; a sum of tricyclic compounds as aromatic and cycloaliphatic of 50-100 wt. %, based on total weight of the decarboxylated rosin acid; and an amount of cycloaliphatic compounds of 15-100 wt. %, based on total weight of the decarboxylated rosin acid. The decarboxylated rosin acid solubilizes the viscosity index improver in less than 3 hours at a temperature of 120° C.

In an aspect, a lubricating oil composition comprising the viscosity modifier concentrate is disclosed.

DESCRIPTION

The following terms will be used throughout the specification with the following meanings unless specified otherwise.

"At least one of [a group such as A, B, and C]" or "any of [a group such as A, B, and C]," or "selected from [A, B, and C]," means a single member from the group, more than one member from the group, or a combination of members from the group. For example, at least one of A, B, and C includes, for example, A only, B only, or C only, as well as A and B, A and C, B and C; or A, B, and C, or any other all combinations of A, B, and C. In another example, at least one of A and B means A only, B only, as well as A and B.

A list of embodiments presented as "A, B, or C" is to be interpreted as including the embodiments, A only, B only, C only, "A or B," "A or C," "B or C," or "A, B, or C."

"Hydrogenation of DCR" refers to a reaction involving addition of hydrogen (H2) to DCR molecules resulting in saturation of carbon-carbon double bonds. The hydrogenation of DCR aims to modify its chemical structure to enhance certain properties or achieve specific characteristics, e.g., stability, color, etc. Unless specified otherwise in the specifications, DCR refers to hydrogenated DCR as well as DCR that is not hydrogenated. DCR after hydrogenation is referred to as hydrogenated DCR or hDCR.

"Double Bond Equivalent" or DBE refers to a degree of unsaturation or a number of double/triple bonds present in a compound/molecule.

Wear Preventive Characteristics of Lubricating Fluid (Four-Ball Method) can be measured per ASTM D4172.

Evaluating Lubricity of Diesel Fuels by the High-Frequency Reciprocating Rig (HFRR) can be measured per ASTM D6079.

Kinematic viscosity can be measured per ASTM D445.

Thermal conductivity can be measured per ASTM D4308.

Dielectric constant can be measured per ASTM D924.

Electrical conductivity can be measured per ASTM D4308.

Dissipation Factor or Power Factor can be measured at 25° C. and 100° C. (as indicated below) per ASTM D924.

Molecular weight (MW) of compounds or components/species in a compound can be determined by MS (mass spectroscopy), preferably in combination with a chromatographic separation method like GC (gas chromatography) or HPLC (high performance liquid chromatography). In embodiments, the MW is determined by GC-MS, using a column with a highly-substituted cyanopropyl phase (e.g. Supelco SP-2330, Restek rtx-2330, or Agilent HP-88) of the size 30 m×0.25 mm×0.20 μm, with the following operating parameters: a temperature profile of 100° C. for 5.0 min, heating with 5° C./min to 250° C. and holding this temperature for 10.00 min; forming a solution with 10 mg of compound in 1 ml of a suitable solvent such as toluene, cyclohexane, etc.; injecting 1 μl of the solution with a split ratio of 1:40 at 250° C.; maintaining the flow at 1 ml/min throughout the analysis. Identification of the individual components is performed by QMS (quadrupole mass spectrometry) detector, with an ion source temperature of 200° C. and a mass range of 35-500 amu.

"Solubility Parameter" or (8) of a solvent or polymer, refers to the square root of the vaporization energy (ΔE) divided by its molar volume (V), as in the equation $\delta=(\Delta E/V)^{1/2}$. The more similar the solubility parameters of two substances, the higher will be the solubility between them and hence the expression "like dissolves like." Hansen established that the solubility parameter of a solvent or polymer is the result of the contribution of three types of interactions: dispersion forces ($\delta D^2$), polar interactions ($\delta P^2$), and hydrogen bonds ($\delta H^2$) (Hansen, 2007; Hansen, 1967), with the total solubility (Hildebrand) parameter $\delta_T$ as the result of contribution of each of the three Hansen solubility parameters (HSP) according to: $\delta_T=(\delta 2_D+\delta 2_P+\delta 2_H)^{1/2}$.

The disclosure relates to viscosity improver concentrates comprising a bio-based liquid decarboxylated rosin acid as a solubilizer and a viscosity index modifier. The viscosity improver concentrate is used in lubricating oil compositions comprising base oil and optional additives.

Viscosity Improver Concentrate: The viscosity improver concentrate comprises, consists essentially of, or consists of a decarboxylated rosin acid as a solubilizer, a viscosity index modifier, and optional additives.

In embodiments, the viscosity improver concentrate is present in lubricating oil composition in an amount of <30 wt. %, or 2-30 wt. % or 3-25 wt. %, or 4-20 wt. % or 5-15 wt. %, based on the total amount of the lubricating oil composition.

Decarboxylated Rosin Acid (DCR): The bio-based liquid is a decarboxylated rosin acid (DCR). The DCR is a rosin-derived composition obtained by decarboxylating a rosin acid, or by dimerizing and decarboxylating a rosin acid and separating/removing the dimerized species. The DCR is in the form of a liquid, and can be any of a crude DCR, a distilled or purified DCR, or mixtures thereof. The DCR can be hydrogenated and/or functionalized. Crude DCR is DCR containing 5-25 wt. % of higher molecular weight (450-1500 Da) components, e.g., hydrocarbons, oligomers, polymers, impurities, or dimer/trimer of fatty acids. Distilled or purified DCR refers to crude DCR having heavy fractions removed to improve color, reduce sulfur, etc. Hydrogenated DCR refers to DCR that has undergone hydrogenation for the reduction of C═C double bonds and obtain hydrogenated compounds. Unless specified otherwise, DCR herein refers to both unhydrogenated DCR (crude, distilled or purified), or hydrogenated DCR.

DCR is produced by the decomposition of rosin acids at high temperatures, e.g., 220-300° C. Rosin acids are normally solid, having a softening point of, e.g., 65-85° C. The rosin acid can be fully decarboxylated forming DCR. The rosin acid can be partially decarboxylated, forming DCR, which is a mixture of molecules, some of which contain monocarboxylic acids having a general molecular formula, e.g., $C_{20}H_{30}O_2$.

In embodiments, the DCR comprises one or more C═C groups, 40-100 wt. % of tricyclic species having 18-20 carbon atoms, 0-30 wt. % of components with <19 carbon atoms, and 40-100 wt. % of components with a molecular formula in the range from $C_{19}H_{20}$ to $C_{19}H_{34}$, based on the total weight of the DCR. In embodiments, sum of tricyclic species as aromatic and cycloaliphatic in the DCR is >50 wt. %, or >55 wt. %, or >60 wt. %, or >74 wt. %, or >90 wt. %, or up to 100 wt. %, or 50-100 wt. %, or 55-100 wt. %, or 60-100 wt. %, or 74-100 wt. %, or 50-95 wt. %, of total weight of the DCR. Aromatic DCR is defined as DCR species having a MW of 252-256, with MW of 254 as having a reactive double bond, and cycloaliphatic DCR is defined as DCR species having a MW of 260 or 262.

In embodiments, the DCR has a C19 (MW 248-262) content of >50 wt. %, or >60 wt. %, or >70 wt. %, or >80 wt. %. In embodiments, the amount of cycloaliphatic DCR (MW 260 and 262) is >15 wt. %, or >20 wt. %, or >30 wt. %, or >40 wt. %, or >50 wt. %, or >80 wt. %, or 15-90 wt. %, or 15-85 wt. %, or 25-80 wt. %, or 40-80 wt. %, based on the total weight of the DCR.

In embodiments, total amount of tricyclic species having reactive double bond (C═C group) is <5 wt. %, <3 wt. %, <1 wt. %, or 0 wt. % of total weight of the DCR. Reactive C═C group is defined as DCR species having a MW of 254 or 258.

In embodiments, the DCR has C19 species with MWs of 254, 250, and 248 in an amount of <5 wt. %, or <3 wt. %, or <1 wt. %, or <0.5 wt. %, or 0 wt. %.

In embodiments, the DCR has a C13 species with MWs of 174 and 180 in an amount of 5-20 wt. %, or 5-15 wt. %, or >5 wt. % or <20 wt. %.

In embodiments after hydrogenation, the amount of tricyclic species having 18-20 carbon atoms in the hDCR goes up to at least 70 wt. %, or 75-100, or 75-95, or 80-100, or 80-95 wt. %, based on total weight of the hDCR.

In embodiments before hydrogenation, the unhydrogenated DCR contains C19 species with a MW of 262 in an amount of 5-20 wt. %, or 5-15 wt. %, or <25 wt. %, or <20 wt. %, or <15 wt. %. After hydrogenation, the hDCR contains C19 species with a MW of 262 in an amount of 25-100 wt. %, or 25-90 wt. %, or 25-80 wt. %, or 40-75 wt. %, or 50-70 wt. %, or >25 wt. %, or >35 wt. %, or >50 wt. %, or >75 wt. %.

In embodiments before hydrogenation, the unhydrogenated DCR contains C19 species with a MW of 260 in an amount of 5-25 wt. %, or 10-20 wt. %, or >5 wt. %, or >10 wt. %, or >15 wt. %, or <20 wt. %. After hydrogenation, the hDCR contains C19 species with a MW of 260 in an amount of 0-5 wt. %, or 0-3 wt. %, or 0-1 wt. %, or <5 wt. %, or <2 wt. %, or 0 wt. %.

In embodiments before hydrogenation, the unhydrogenated DCR contains C19 species with a MW of 256 in an amount of 35-55 wt. %, or 40-50 wt. %, or >37 wt. %, or >40 wt. %, or >45 wt. %. After hydrogenation the hDCR contains C19 species with a MW of 256 in an amount of 0-40 wt. %, or 5-35 wt. %, or 10-30 wt. %, or <40 wt. %, or <30 wt. %.

In embodiments before hydrogenation, the unhydrogenated DCR contains C19 species with a MW of 252 in an amount of 5-20 wt. %, or 5-15 wt. %, >5 wt. %, or >10 wt. %. After hydrogenation, the hDCR contains C19 species with a MW of 252 in an amount of 0-5 wt. %, or 0-3 wt. %, or <5 wt. %, or <3 wt. %, or <1 wt. %, or 0 wt. %.

In embodiments before hydrogenation, the unhydrogenated DCR contains C13 species with a MW of 180 in an amount of 0-5 wt. %, or 0-3 wt. %, or <5 wt. %, or <2 wt. %, or <1 wt. %, or 0 wt. %. After hydrogenation, the hDCR contains C13 species with a MW of 180 in an amount of 0-25 wt. %, or 5-20 wt. %, or 5-15 wt. %, or >5 wt. %, or >7 wt. %, or >10 wt. %.

In embodiments before hydrogenation, the unhydrogenated DCR contains C13 species with a MW of 174 in an amount of 5-25 wt. %, 5-20 wt. %, or 5-15 wt. %, or >5 wt. %, or >10 wt. %, or <20 wt. %. After hydrogenation, the hDCR contains C13 species with a MW of 174 in an amount of 0-5 wt. %, or 0-3 wt. %, or <5 wt. %, of <2 wt. %, or 0 wt. %.

The MW of the species in unhydrogenated DCR and hDCR as measured using the analytical methods previously specified (e.g., MS, MS/GC/HPLC, and GC-MS) can be identified by the following retention profile: MW of 174 g/mol, 7.0-8.5 minutes; MW of 180 g/mol, 2.5-4.0 minutes; MW of 248 g/mol, 32.5-34.5 minutes; MW of 250 g/mol, 26.0-31.0 minutes; MW of 252 g/mol, 24.5-31.0 minutes; MW of 254 g/mol, 16.5-25.0 minutes; MW of 256 g/mol, 16.5-25.0 minutes; MW of 260 g/mol, 11.0-16.0 minutes; and MW of 262 g/mol, 11.0-16.0 minutes. For components with overlapping retention time ranges, the mass spectrum of each peak is used to identify the MW of the component. Components with the same MW (isomers) are clustered and the total amount per isomer is reported.

In embodiments, the hDCR comprises at least 5 isomers, or 10 isomers, or 20 isomers, or 50 isomers, or 100 isomers of a species having a molecular formula of $C_{19}H_{34}$ and a MW of 262 g/mol.

In embodiments after hydrogenation, the hDCR comprises C═C double bonds in amounts of <40%, or <30%, or <20%, or <15%, or <10%, or <5%, or >1%, or 1-40%, or 2-20%, or 1-10%.

In embodiments after hydrogenation, the hDCR comprises an average Double Bond Equivalent in an amount of 0.1-2, or 0.2-1.5, or 0.5-1.4, or 0.5-2, or <2, or <1.8, or <1.5, or <1.2, or >0.1.

In embodiments, DCR is characterized as having a m/z (mass/charge) value in the range of 170-280, or 220-280, or 230-270, or 234-262, or 235-265, or >230, or <265, measured by GC-FID-MS.

In embodiments, DCR is characterized as having an oxygen content of <5%, or <3%, or <2%, or <0.9%, or <0.5, or <0.2%, or <0.1%, or 0-5%, or 0-3%, or 0-2%, or 0-1%. The oxygen content (in %) can be calculated as oxygen to carbon ratio, or the sum of oxygen atoms present divided by sum of carbon atoms present, with the number of oxygen and carbon atoms being obtained from elemental analyses.

In embodiments, unhydrogenated DCR is characterized as having a lower acid value (carboxylic acid content) than the rosin acid feedstock for making the DCR. In embodiments, the DCR has an acid value of <50, or <45, or <40, or <35, or <30, or <25, or <20, or <15, or <10, or <7, or <5, or 0.5-40, or 0.5-30, or 0.5-20, or 1-20, or 1-15, or 1-15, or 1-10 mg/KOH, as measured using ASTM D1240-14 (2018) or ASTM D465.

In embodiments, hDCR has an acid value of <1, or <0.8, or <0.5, or <0.2, or 0.01-1, or 0.1-0.8, or 0.01-0.5 mg KOH/g, as measured using ASTM D1240-14 (2018) or ASTM D465.

In embodiments, DCR has a density of 0.9-1.0, or 0.91-0.99, or 0.92-0.98, or 0.93-0.97, or 0.94-0.96, or >0.9, or <1.1 g/cm$^3$.

In embodiments, DCR is characterized as having viscosities comparable to those of petrochemical base oils, due in part to its relatively high molecular weights, for example, a viscosity of 5-60, or 10-60, 15-60, or 5-55, or 10-50, or 10-45, or 15-40, or >5, or >10, or >20, or >25, or >28, or <45, or <50, or <60 cSt according to ASTM D-445, measured at 40° C.

In embodiments, unhydrogenated DCR has an aniline point of 3-40° C., or 5-40° C., or 5-30° C., or 5-25° C., or 2-20° C., or 5-20° C., or 5-15° C., or <25° C., or <20° C., or >3° C., or >5° C., or >8° C., according to ASTM D611.

In embodiments, hDCR has an aniline point of 20-80° C., 30-70° C., 30-60° C., 40-50° C., or >20° C., or >30° C., or >40° C., or <70° C., according to ASTM D611.

In embodiments, unhydrogenated DCR has a pour point of −40 to +10° C., or −35 to +8° C., −30 to +5° C., or −30 to +0° C., or −30 to −5° C., or −28 to 0° C., or −28 to −5° C., or −28 to −10° C., or >−40° C., or >−30° C., or >−28° C., or <+5° C., or <+10° C., according to ASTM D97.

In embodiments, hDCR has a pour point of −40 to −10° C., or −35 to −20° C., or −35 to −25° C., or <0° C., or <−5° C., <−10° C., or >−40° C., or >−35° C., or according to ASTM D97.

In embodiments, unhydrogenated DCR has a flash point of 135-180° C. or 135-175° C., or 135-165° C., or 135-160° C., or 140-175° C., or 140-160° C., or 140-158° C., or 140-155° C., or >135° C., or >140° C., or <175° C., or <165° C., or <160° C., according to ASTM D92.

In embodiments, hDCR has a flash point of 95-140° C., or 100-135° C., or 95-135° C., or <140° C., or <135° C., or >95° C., or >100° C., according to ASTM D92.

In embodiments, DCR has a boiling point of 200-390° C., or 210-390° C., or 235-390° C., or 280-380° C., or 290-370° C., or 300-360° C., or >290° C., or >230° C., or >210° C., or <400° C., or <370° C., measured according to ASTM D2887.

In embodiments, unhydrogenated DCR has a Gardner Color of 0-12.0, or 0.5-12.0, or 0.8-12.0, or 0.9-11, or 1.0-10.0, or 1.0-6.0, or 1.0-5, or >0, or >1.0, or >1.2, or <10.0, or <7.0, or <6.0, or <5.0, or <2.4, or <3.0, according to ASTM D6166.

In embodiments, hDCR has a Gardner Color of <1, or <0.8, or <0.5, or <0.2, or 0.1-1, or 0.15-0.8, or 0.1-0.5, according to ASTM D6166.

In embodiments, unhydrogenated DCR has a sulfur content of <500 ppm (0.05 wt. %), or <300 ppm (0.03 wt. %), or <200 ppm (0.02 wt. %), or <100 ppm (0.01 wt. %), or <10 ppm (0.001 wt. %), or 20-700 ppm (0.002-0.7 wt. %), 30-500 ppm (0.003-0.5 wt. %), or 40-400 ppm (0.004-0.4 wt. %), or 40-300 ppm (0.004-0.3 wt. %), or 40-200 ppm (0.004-0.2 wt. %), based on total weight of the DCR, measured according to ASTM D5453.

In embodiments, hDCR has a sulfur content of 0.001-10 ppm, or 0.001-5 ppm, or <10 ppm, or <8 ppm, or <5 ppm, or >0.001 ppm, measured according to ASTM D5453.

In embodiments, DCR has a VOC of <5, or <4.75, or <4.5, or <4.25, or <4.0, or <3.75, or <3.5, or <3.25, or <3.0, or <2.75, or <2.5, or <2.25, or <2.0, or <1.5, or <1.0, or <0.5 wt. %, based on total weight of the DCR. The VOC of the DCR is measured according to methods: i) summing the percent by weight contribution from all VOCs present in the product at 0.01% or more, or ii) according to the EPA (Environmental Protection Agency) method 24 or equivalent.

In embodiments, DCR has a Kb (Kauri butanol) value of 25-90, or 30-85, or 35-80, or 40-75, or 45-70, or 50-65, or >40, or >50, or >60, or >70, or >80, according to ASTM D1133.

In embodiments, unhydrogenated DCR has a viscosity index of >−200, or −200 to −50, or <0, or <−50, measured according to ASTM D2270. In embodiments, hDCR has a viscosity index of <25, or <0, or −50 to 0, or >−50, measured according to ASTM D2270. The viscosity index is an arbitrary, unit-less measure of a fluid's change in viscosity relative to temperature change, for example, index of viscosity at 40° C. and viscosity at 100° C.

In embodiments, DCR has a δD value of 14-18, or 14.2-17.8, or 14.5-17.5, or 15-17, or 15.2-16.5 $MPa^{1/2}$; a δP value of 3-6, or 3.2-5.5, or 3.4-5.2, or 3.5-5.0 $MPa^{1/2}$; and δH value of 7-10, or 7.5-9.5, or 8-9, or 8.2-8.8 $MPa^{1/2}$.

In embodiments, unhydrogenated DCR has a surface tension of 25-50, or 28-45, or 30-40 dynes/cm, according to ASTM D1331.

In embodiments, DCR has a thermal conductivity of 0.05-0.2, or 0.07-0.17, or 0.08-0.015 W/Mk, according to ASTM D4308.

In embodiments, DCR has a dielectric constant of 1-5, or 1-4, or 2-4, or 2-3, or 2.0-2.75, according to ASTM D924.

In embodiments, DCR has a specific heat capacity of 1475-1800, or 1500-1750, or 1500-1700 J/kg K, according to ASTM E1269.

In embodiments, DCR has an electrical conductivity of <3, or <2, <1, or 0.1-3, or 0.1-2, or 0.1-1 Ps/m, according to ASTM D4308.

In embodiments, DCR has a Power Factor at 25° C. of 0.001-2, 0.001-1, 0.001-0.1, or 0.005-0.05, or <2, or <1.5 or <1, or <0.5, or <0.25.

In embodiments, unhydrogenated DCR has a Power Factor at 100° C. of 1-3, or 1.5-3, or 2-2.5, or >1, or >2 or <3, according to ASTM D924.

In embodiments, hDCR has a Power Factor at 100° C. of 0.01-1, or 0.1-0.75, or <1, or >0.05, according to ASTM D924.

In embodiments, the DCR is present in the viscosity modifier concentrate composition in an amount of >90 wt. %, or 90-99.9 wt. %, or 95-99.9 wt. % or 97-99.5 wt. %, based on the total weight of the viscosity modifier concentrate composition.

Viscosity Modifiers: The viscosity modifier concentrate comprises viscosity modifiers, or viscosity index improvers. The viscosity index improver can include hydrogenated styrene-butadiene rubbers, ethylene-propylene copolymers, ethylene copolymers with propylene and olefins, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655, incorporated herein by reference), esters of maleic anhydride-styrene copolymers, or mixtures thereof. In embodiments, the viscosity index improver includes a block copolymer comprising (i) a vinyl aromatic monomer block and (ii), a conjugated diene olefin monomer block (such as a hydrogenated styrene-butadiene copolymer or a hydrogenated styrene-isoprene copolymer), a polymethacrylate, an ethylene-alpha olefin copolymer, a hydrogenated star polymer comprising conjugated diene monomers such as butadiene or isoprene, or a star polymer of polymethacrylate, or mixtures thereof.

In embodiments, viscosity index improver polymers based on olefins include monomers consisting of carbon atoms and hydrogen atoms, such as ethylene, propylene, butylene and diene monomers, such as butadiene, as described in US2017158980, incorporated herein by reference.

In embodiments, polyalkyl (meth)acrylates are based on alkyl (meth)acrylate monomers conventionally comprising 1 to 4000 carbon atoms in the alkyl group of the (meth) acrylates. Polyalkyl (meth)acrylates are described in U.S. Pat. Nos. 5,130,359, 6,746,993, 5,130,359, and 6,746,993, all incorporated herein by reference.

The viscosity index improver can comprise dispersing groups such as nitrogen-containing and/or oxygen-containing functional groups. Nitrogen-containing functional groups can be added to a polymeric viscosity index improver by grafting a nitrogen- or hydroxyl-containing moiety, onto the polymeric backbone of the viscosity index improver (functionalizing). Multifunctional viscosity index improves are disclosed in U.S. Pat. Nos. 2,737,496, 4,021,357, 3,249,545, 6,331,510, 6,204,224, and 6,372,696, and PCT Publication No. WO 2008/055976, all incorporated herein by reference.

In embodiments, the molecular weight of polymers useful as viscosity index improvers have a molecular weight ranging from 2,000-12,000,000, or 5,000-1,000,000 or 5,000-750,000.

In embodiments, the viscosity index improver is a styrenic block copolymer ("SBC") having a general configuration of A-B, A-B-A, B-A-B, A-B-A-B, A-B-A-B-A, $(A-B)_n$, $(A-B)_n(A)$, $(A-B-A)_n$, $(A-B-A)_nX$, $(A-B)_nX$, $(B-A-B)_nX$, $(A-B-A-B)_nX$, $(A-B-A-B-A)_nX$, A'-B, A'-B-A, A-B-A', A'-B-A', B-A'-B, A'-B-A-B, A-B-A'-B, A'-B-A'-B, A'-B-A-B-A, A-B-A'-B-A, A-B-A-B-A', A'-B-A'-B-A, A-B-A'-B-A', $(A'-B)_n$, $(A-B)_n(A')$, $(A'-B)_n(A)$, $(A'-B)_n(A')$, $(A'-B-A)_n$, $(A-B-A')_n$, $(A'-B-A')_n$, $(A'-B-A)_nX$, $(A-B-A')_nX$, $(A'-B-A')_nX$, $(A'-B)_nX$, $(B-A'-B)_nX$, $(A'-B-A-B)_nX$, $(A-B-A'-B)_nX$, $(A'-B-A'-B)_nX$, $(A'-B-A-B-A)_nX$, $(A-B-A'-B-A)_nX$, $(A-B-A-B-A')_nX$, $(A'-B-A'-B-A)_nX$, $(A-B-A'-B-A')_nX$, A-B', A-B'-A, B'-A-B, B-A-B', B'-A-B', A-B'-A-B, A-B-A-B', A-B'-A-B', A-B'-A-B-A, A-B-A-B'-A, A-B'-A-B'-A, $(A-B')_n$, $(A-B')_n(A)$, $(A-B'-A)_n$, $(A-B'-A)_nX$, $(A-B')_nX$, $(B'-A-B)_nX$, $(B-A-B')_nX$, $(B'-A-B')_nX$, $(A-B'-A-B)_nX$, $(A-B-A-B')_nX$, $(A-B'-A-B')_nX$, $(A-B'-A-B-A)_nX$, $(A-B-A-B'-A)_nX$, $(A-B'-A-B'-A)_nX$, A'-B', A'-B'-A', B'-A'-B', A'-B'-A'-B', A'-B'-A'-B'-A', $(A'-B')_n$, $(A'-B')(A')$, $(A'-B'-A')_n$, $(A'-B'-A')_nX$, $(A'-B')_nX$, $(B'-A'-B')_nX$, $(A'-B'-A'-B')_nX$, $(A'-B'-A'-B'-A')_nX$, or mixtures thereof; where n is an integer from 2 to 30; and X is a residue of a coupling agent.

Each block A and A' is same or different and independently a polymer block of vinyl aromatic monomer. Each block B is independently a polymer block of a conjugated diene monomer or a mixture of 2 or more conjugated diene monomers, each B' consists of at least one vinyl aromatic monomer and conjugated diene monomer. The mixture of vinyl aromatic monomer and conjugated diene monomer in each block B' can be any of tapered, random, block structure, or a controlled distribution copolymer block.

In embodiments, the vinyl aromatic monomer is selected from the group consisting of styrene, para-methylstyrene, para-ethylstyrene, para-n-propylstyrene, para-iso-propylstyrene, para-n-butylstyrene, para-sec-butylstyrene, para-iso-butylstyrene, para-t-butylstyrene, isomers of para-decylstyrene, isomers of para-dodecylstyrene, ortho-substituted styrene, meta-substituted styrene, alpha-methylstyrene, 1,1-diphenylethylene, and mixtures thereof.

In embodiments, the conjugated diene monomer is selected from the group consisting of isoprene, 1,3-butadiene, 2,3-dimethyl-1,3-butadiene, 1-phenyl-1,3-butadiene, 1,3-pentadiene, 1,3-hexadiene, 3-butyl-1,3-octadiene, farnesene, myrcene, piperylene, cyclohexadiene, and mixtures thereof.

In embodiments, each block A and A' independently has a peak molecular weight of >1 kg/mol, or >5 kg/mol, or >7 kg/mol, or >10 kg/mol, or >15 kg/mol, or >30 kg/mol, or >40 kg/mol, or >50 kg/mol, or >75 kg/mol, or >100 kg/mol, or <200 kg/mol, or <150 kg/mol, or <100 kg/mol, or 1-200 kg/mol, or 1-150 kg/mol, or 1-100 kg/mol, or 1-75 kg/mol, or 1-50 kg/mol.

In embodiments, each block B and B' independently has a peak molecular weight of >5 kg/mol or >10 mg/mol, or >15 kg/mol, or >25 kg/mol, or >50 kg/mol, or <100 kg/mol, or <250 kg/mol, or 5-350 kg/mol, or 5-300 kg/mol, or 7-250 kg/mol, or 10-200 kg/mol, or 5-150 kg/mol, or 10-100 kg/mol.

In embodiments, the SBC has a total peak molecular weight of 5-1000 kg/mol, or 5-750 kg/mol, or 10-500 kg/mol, or 20-300 kg/mol, or 50-300 kg/mol, or 50-250 kg/mol, or <750 kg/mol, or <500 kg/mol, or >5 kg/mol, or >10 kg/mol, based on the total weight of the SBC.

In embodiments, when the SBC is hydrogenated, the polymer block A has a hydrogenation level of <30, or <20, or <10, or <5 mol %, based on the total mol of the polymerized vinyl aromatic monomer. In embodiments, when the SBC is hydrogenated, the polymer block B or B' has a hydrogenated level of >20, or >30, or >40, or 50, or >60 >70, or >80, or >90, or >95, or >98, or >99, or 20-99, or 50-99 or 70-99 mol %, based on the total mol of the polymerized conjugated diene monomer in the polymer block B or B'. The hydrogenation level refers to the % of original unsaturated bonds which become saturated upon hydrogenation, which can be determined using UV-VIS spectrophotometry and/or proton NMR and/or via ozonolysis titration.

In embodiments, when the SBC is coupled, the SBC has a coupling efficiency (CE) of 0-100%, or 10-99%, or 20-95%, 30-95%, 50-95%, or >50%, or >60%, or >65%, or >70%, or <100% or <95%.

In embodiments, the SBC has a total polystyrene content of >5 wt. %, or >10 wt. %, or <70 wt. %, or <60 wt. %, or <50 wt. %, or 1-60 wt. %, or 5-50 wt. %, or 20-40 wt. %. or 25-35 wt. %, based on the total weight of the SBC.

In embodiments, the viscosity index improver is present in the viscosity modifier concentrate in an amount of <10 wt. %, or 0.01-10 wt. %, or 0.1-10 wt. %, or 0.1-7 wt. %, or 0.1-5 wt. %, or 0.5-3 wt. %, based on the total weight of the viscosity modifier concentrate composition.

Optional Additives: Viscosity modifier concentrate compositions may further comprise at least one additive selected from the group of extreme pressure additives, antioxidants, solubility additives, friction modifiers, antifoam agent, dispersants, detergents, corrosion inhibitors, rust inhibitors, metal deactivators, anti-wear agents, anti-seizure agents, wax modifiers, viscosity index improvers, viscosity modifiers, fluid-loss additives, seal compatibility agents, lubricity agents, anti-staining agents, chromophoric agents, demulsifiers, emulsifiers, densifiers, wetting agents, gelling agents, tackiness agents, colorants, and others, and a combination thereof. For a review of many commonly used additives, see Klamann in Lubricants and Related Products, Verlag Chemie, Deerfield Beach, Fla.; ISBN 0-89573-177-0. Reference is also made to "Lubricant Additives Chemistry and Applications" edited by Leslie R. Rudnick, Marcel Dekker, Inc. New York, 2003 ISBN: 0-8247-0857-1; see also U.S. Pat. No. 7,704,930, incorporated herein in by reference.

In embodiments, the additives are present in the viscosity modifier concentrate composition in an amount of 0-35.0 wt. %, or 0.01-30 wt. %, or 0.05-25.0 wt. %, or 0.1-20.0 wt. %, or 0.5-10.0 wt. %, based on the total weight of the viscosity modifier concentrate composition.

Method for Preparation Viscosity Modifier Concentrate: The viscosity modifier concentrates can be prepared by dissolving the viscosity index improver(s) in the solubilizer using well-known techniques.

When dissolving a solid viscosity index improver to form a concentrate, the high viscosity of the polymer can cause poor diffusivity in the solubilizer. To facilitate dissolution, it can be common to increase the surface area of the viscosity index improver by, pelletizing, chopping, grinding, or pulverizing the viscosity index improver. The temperature of the solubilizer can also be increased by heating to a temperature of <150° C., or <140° C., or >120° C., or >125° C., or 130-150° C. Dissolution of the polymer can also be aided by agitating the concentrate, such as by stirring or agitating, or by using a recirculation pump. Any two or more of the foregoing techniques can also be used in combination.

The viscosity modifier concentrate can be part of an additive package. The additive package can include more than one additive in any proportion.

Performance Properties of Viscosity Improver Concentrate: Viscosity improver concentrates comprising a viscosity improver and DCR as the solubilizer, having comparable properties, such as compatibility, kinematic viscosity, and viscosity index, to other commonly used fossil based solubilizers, e.g., paraffinic oil, naphthenic oil, polyalphaolefin oil, and alkylated naphthalene oil, etc.

In embodiments, the DCR solubilizes the viscosity index improver within 15 minutes to 3 hours, or <3 hours, or <2 hours, or <1 hour, or <30 minutes or <15 minutes, or <10 minutes, or 30 minutes to 3 hours, or 1-3 hours, at <150° C., or <130° C., or <120° C., or >100° C., or 100-150° C., or 120-150° C.

In embodiments, the viscosity improver concentrates (containing DCR as solubilizer and an ethylene/propylene block copolymer as a viscosity index improver) have improved compatibility at >1 wt. %, or >=2.5 wt. %, or >=5 wt. % of viscosity index improver when compared to viscosity improver concentrates with paraffinic oil, polyalphaolefin oil, or alkylated naphthalene oil as solubilizer.

In embodiments, the viscosity improver concentrates (containing DCR as solubilizer and polymethacrylate as a viscosity index improver) have improved compatibility at >1 wt. %, or >=2.5 wt. %, or >=5 wt. % of viscosity index improver when compared to viscosity improver concentrates with polyalphaolefin oil as solubilizer.

Methods of Making Lubricating Oil Compositions. In embodiments, the finished lubricating oil includes the viscosity index improver concentrate and a base oil. In embodiments, the finished lubricant oil composition can also include an additive (apart from the viscosity index improver concentrate) and a base oil (e.g., a Group I, Group II, Group III, Group IV, Group V base oil, or a combination thereof). Such additives can include, but are not limited to, extreme pressure additives, antioxidants, solubility additives, friction modifiers, antifoam agent, dispersants, detergents, corrosion inhibitors, rust inhibitors, metal deactivators, anti-wear agents, anti-seizure agents, wax modifiers, viscosity index improvers, viscosity modifiers, fluid-loss additives, seal compatibility agents, lubricity agents, anti-staining agents, chromophoric agents, demulsifiers, emulsifiers, densifiers, wetting agents, gelling agents, tackiness agents, colorants, and others, and a combination thereof. For a review of many commonly used additives, see Klamann in Lubricants and Related Products, Verlag Chemie, Deerfield Beach, Fla.; ISBN 0-89573-177-0. Reference is also made to "Lubricant Additives Chemistry and Applications" edited by Leslie R. Rudnick, Marcel Dekker, Inc. New York, 2003 ISBN: 0-8247-0857-1. Additives can be added individually or be included as additive packages for use in lubricating compositions.

In embodiments, a method of forming a lubricating oil composition can include introducing a base oil (e.g., a Group I, Group II, Group III, Group IV, Group V base oil, or a combination thereof) to a viscosity modifier concentrate to form a lubricating oil composition. In embodiments, the method of forming a lubricating oil composition can further include introducing one or more additives to the lubricating oil composition. In embodiments, the method of forming a lubricating oil composition can include an additive package comprising the viscosity improver concentrate.

The lubricating oil composition can be prepared by blending the viscosity modifier concentrates in a base oil using techniques known in the art.

In embodiments, the lubricating oil composition is formed by combining the DCR, the viscosity index improver, and the base oil without the need for first forming the viscosity modifier concentrate. In embodiments, the DCR is present in an amount of <20 wt. %, or <15 wt. %, or <10 wt. %, or 2-20 wt. %, or 5-15 wt. % based on the total weight of the lubricating oil composition. In embodiments, the viscosity index improver is present in an amount of <5 wt. %, or 0.1-5 wt. %, or 0.5-3 wt. %, based on the total weight of the lubricating oil composition.

Performance Properties of Lubricating Oil: Lubricating oil compositions comprising the viscosity index improver concentrate or DCR as solubilizer, show improved viscometric performance while reducing treat rates and the amount of base oil in the finished lubricating oil. Moreover, the DCR solubilizer can provide enhanced solvency and oxidative stability of the lubricating oil composition.

In embodiments, the DCR solubilizes more viscosity index improver in the lubricating oil composition without impacting the performance of the final lubricating oil composition.

Applications: The lubricating oil composition is suitable for use in various applications, including automotive engines and gears, e.g., internal combustion engine, hypoid gear, automotive spiral-bevel and worm gear axels. In embodiments, the lubricating oil composition is used in any of functional fluids, industrial lubricants, circulation oils, steam turbine oils, gas turbine oils (both heavy-duty gas turbines and aircraft gas turbines), machine tool lubricants and hydraulic fluids.

Examples: The components used in the examples are as follows.

The solubilizers used in the examples are DCR, paraffinic oil, naphthenic oil, polyalphaolefin oil, and alkylated naphthalene oil.

The DCR sample is from Kraton Corporation and has properties as shown in Table 1. DCR 1 also has the following: %02 content of 0.1; % tricyclic species of 77.7, aromatic (with MW of 252) of 14.0; reactive double bond (with MW of 254) of 0.5; aromatic (with MW of 256) of 45.3; reactive double bond (with MW of 258) of 0.8; and cycloaliphatic (with MW 260) of 0.3. DCR 2 also has the following: aromatic (with MW of 252) of 0; reactive double bond (with MW of 254) of 0; aromatic (with MW of 256) of 26; and cycloaliphatic (with MW 260) of 0.

TABLE 1

| DCR samples | | |
|---|---|---|
| | DCR 1 | DCR 2 |
| Acid Number mg KOH/g | 2 | 0.1 |
| Gardner Color | 1 | 0.0 |
| Viscosity, cSt @ 40° C. | 25.2 | 17.5 |
| Density, 40° C. | 0.95 | 0.9215 |
| Flash Point, COC (° C.) | 141 | 124 |
| Aniline Point | 13 | N/A |
| Pour Point (° C.) | −26 | −33 |

Paraffinic oil is a commercially available paraffinic mineral oil with a viscosity index of 108, according to ASTM D7042.

Naphthenic oil is a commercially available naphthenic mineral oil with a viscosity index of 21, according to ASTM D7042.

Polyalphaolefin oil is a commercially available polyalphaolefin oil with a viscosity index of 152.4, according to ASTM D7042.

Alkylated naphthalene oil is a commercially available alkylated naphthalene oil with a viscosity index of 112.6, according to ASTM D7042.

Viscosity Improver 1 (VI 1) is linear diblock copolymer based on styrene and ethylene/propylene with a polystyrene content of 37%, and a viscosity of 17 cSt at 100° C.

Viscosity Improver 2 (VI 2) is a hydrogenated isoprene-styrene (EP-S) polymer with a polystyrene content of 28% and kinematic viscosity of 20 cSt (1.23% w at 100° C.) per BAM 1201.

Viscosity Improver 3 (VI 3) is a hydrogenated SEP(S)/EP star copolymer with a melt flow rate of 8 g/10 min. at 200° C./5 kg, and a Brookfield viscosity of 8,700 (25% toluene at) 25° C.

Viscosity Improver 4 (VI 4) is a coupled hydrogenated styrene-butadiene/isoprene star polymer (S-EB/EP) block copolymer with a kinematic viscosity of 18.2 cSt (1.70% w at) 100° C. per BAM 1201.

Viscosity Improver 5 (VI 5) is a hydrogenated styrene/isoprene star polymer with a polystyrene content of 7%, kinematic viscosity of 15 cSt (1.70% w at 100° C.) per BAM 1201.

Viscosity Improver 6 (VI 6) is polymethacrylate with a viscosity of 925 cSt at 100° C. and a density of 0.984 g/cm$^3$ at 15° C. per ASTM D4052.

Viscosity Improver 7 (VI 7) is a polyisobutylene copolymer with a viscosity of 1100 cSt at 100° C. and a density of 7.10 lbs/gal.

The examples were evaluated for dynamic viscosity and density of liquids by Stabinger Viscometer (ASTM D7042) wherein kinematic viscosity and viscosity index were determined. The results are shown in Tables 2-4 below.

The examples were evaluated to determine cloud point pursuant to ASTM D4172-94. The results are in Tables 2-4 below.

The examples were also studied for compatibility and ranked as clear, insoluble, slight haze, or cloudy at RT in Tables 2-4 below. A ranking of "clear" indicates samples had no haze or cloudiness (transparent). "Insoluble" indicates that after stirring on a 150° C. hot plate for 3 hours, the bulk of the additive had not solubilized and would drop out to the bottom of the container when stirring ceased. "Slight haze"

was visually judged to be 3, on a scale of 1-5, with 1 being transparent and 5 being opaque, after stirring on a 150° C. hot plate for 3 hours. "Cloudy at RT" indicates the sample was below the transmittance level at room temperature after attempted determination by an instrument used to determine cloud point at <60% light transmittance, after stirring on a 150° C. hot plate for 3 hours.

The viscosity improver concentrates were made by stirring in 20-40 g of the viscosity improver into the indicated solubilizer with a magnetic stirrer on a hot plate set between 120° C. and 150° C. for 15 minutes to three hours. It was observed that DCR 1 and/or DCR 2 (as identified below) solubilized VI 1, VI 2, VI 6 and VI 7 within one hour at 120° C. It was also observed that DCR 1 or DCR 2 (as identified below) solubilized VI 3, VI 4, and VI 5 in 2-3 hours at 120° C. The other oils required a temperature of 150° C. for 1-3 hours to solubilize the viscosity improvers. A viscosity improver that would not solubilize in an oil within 3 hours at 150° C. was deemed insoluble.

Examples 1A-1C were prepared using DCR, paraffinic oil, naphthenic oil, polyalphaolefin oil, and alkylated naphthalene as solubilizers with Viscosity Improver 1 added in the indicated amounts (neat, 1 wt. %, 2.5 wt. %, and 5 wt. %) as indicated in Table 2.

TABLE 2

Viscosity Improver 1 in Solubilizers

| | | | Viscosity Improver 1 | | |
|---|---|---|---|---|---|
| | Property | Neat (0 wt. % VI) | 1A 1 wt. % | 1B 2.5 wt. % | 1C 5 wt. % |
| DCR1 | Compatibility | Clear | Clear | Clear | Clear |
| | Kinematic Viscosity 40° C. (cSt) | 21.0 | 40.6 | 92.9 | 303 |
| | Kinematic Viscosity 100° C. (cSt) | 2.9 | 5.7 | 11.8 | 31.4 |
| | Viscosity Index | −120.1 | 69.3 | 117.8 | 142.7 |
| Paraffinic oil | Compatibility | Clear | Clear | Insoluble | Insoluble |
| | Kinematic Viscosity 40° C. (cSt) | 38.2 | 54.2 | Insoluble | Insoluble |
| | Kinematic Viscosity 100° C. (cSt) | 6.2 | 8.5 | Insoluble | Insoluble |
| | Viscosity Index | 108.6 | 130.2 | Insoluble | Insoluble |
| Naphthenic oil | Compatibility | Clear | Clear | Clear | Insoluble |
| | Kinematic Viscosity 40° C. (cSt) | 20.8 | 61.1 | 501.04 | Insoluble |
| | Kinematic Viscosity 100° C. (cSt) | 3.7 | 6.3 | 13.86 | Insoluble |
| | Viscosity Index | 21 | 12.1 | −193.1 | Insoluble |
| Polyalphaolefin | Compatibility | Clear | Slight haze | Insoluble | Insoluble |
| | Kinematic Viscosity 40° C. (cSt) | 387.3 | 819.2 | Insoluble | Insoluble |
| | Kinematic Viscosity 100° C. (cSt) | 39.7 | 57.8 | Insoluble | Insoluble |
| | Viscosity Index | 152.4 | 130 | Insoluble | Insoluble |
| Alkylated Naphthalene | Compatibility | Clear | Clear | Insoluble | Insoluble |
| | Kinematic Viscosity 40° C. (cSt) | 191 | 364.2 | Insoluble | Insoluble |
| | Kinematic Viscosity 100° C. (cSt) | 19 | 21.4 | Insoluble | Insoluble |
| | Viscosity Index | 112.6 | 94.4 | Insoluble | Insoluble |

Examples 2A-2B and 3A-3B were prepared using DCR 1, DCR 2, paraffinic oil, naphthenic oil, polyalphaolefin oil, and alkylated naphthalene as solubilizers with Viscosity Improver 2 and 3 added in the indicated amounts (neat, 1 wt. % and 5 wt. %) as indicated in Table 3.

TABLE 3

Viscosity Improver 2 and 3 in Solubilizers

| | | | VI 2 | | VI 3 | |
|---|---|---|---|---|---|---|
| | Property | Neat | 2A 1% | 2B 5% | 3A 1% | 3B 5% |
| DCR 1 | Compatibility | Clear | Clear | Clear | Clear | Clear |
| | Kinematic Viscosity 40° C. (cSt) | 21.0 | 55 | 759.3 | 57.4 | 733.2 |
| | Kinematic Viscosity 100° C. (cSt) | 2.9 | 7.4 | 70.7 | 7.7 | 76.9 |
| | Viscosity Index | −120.1 | 94 | 168.2 | 96.6 | 185.9 |
| DCR 2 | Compatibility | Clear | — | Clear | — | Clear |
| | Kinematic Viscosity 40° C. (cSt) | 15.7 | — | 1383.1 | — | 626.5 |
| | Kinematic Viscosity 100° C. (cSt) | 2.9 | — | 59.9 | — | 76.9 |
| | Viscosity Index | −26.8 | — | 93.3 | — | 206.6 |
| Paraffinic oil | Compatibility | Clear | Clear | Insoluble | Clear | Clear |
| | Kinematic Viscosity 40° C. (cSt) | 38.2 | 84.2 | Insoluble | 55.1 | 651.4 |
| | Kinematic Viscosity 100° C. (cSt) | 6.2 | 13.4 | Insoluble | 8.7 | 79 |
| | Viscosity Index | 108.6 | 162.3 | Insoluble | 133.1 | 205.3 |
| Naphthenic oil | Compatibility | Clear | Clear | Clear | Clear | Clear |
| | Kinematic Viscosity 40° C. (cSt) | 20.8 | 82 | 1758.3 | 35 | 534.8 |
| | Kinematic Viscosity 100° C. (cSt) | 3.7 | 7 | 135 | 6.3 | 63.3 |
| | Viscosity Index | 21 | −14.2 | −4.9 | 130.2 | 192.1 |
| Polyalphaolefin | Compatibility | Clear | Insoluble | Insoluble | Clear | Insoluble |
| | Kinematic Viscosity 40° C. (cSt) | 387.3 | Insoluble | Insoluble | 431.4 | Insoluble |

TABLE 3-continued

| Viscosity Improver 2 and 3 in Solubilizers | | | VI 2 | | VI 3 | |
|---|---|---|---|---|---|---|
| | Property | Neat | 2A 1% | 2B 5% | 3A 1% | 3B 5% |
| | Kinematic Viscosity 100° C. (cSt) | 39.7 | Insoluble | Insoluble | 45 | Insoluble |
| | Viscosity Index | 152.4 | Insoluble | Insoluble | 160.4 | Insoluble |
| Alkylated Naphthalene | Compatibility | Clear | Clear | Insoluble | Insoluble | Insoluble |
| | Kinematic Viscosity 40° C. (cSt) | 191 | 361.4 | Insoluble | Insoluble | Insoluble |
| | Kinematic Viscosity 100° C. (cSt) | 19 | 36.7 | Insoluble | Insoluble | Insoluble |
| | Viscosity Index | 112.6 | 147.5 | Insoluble | Insoluble | Insoluble |

Examples 4A-4B and 5A-5B were prepared using DCR 1, DCR 2, paraffinic oil, naphthenic oil, polyalphaolefin oil, and alkylated naphthalene as solubilizers with Viscosity Improver 4 and 5 added in the indicated amounts (neat, 1 wt. % and 5 wt. %) as indicated in Table 4.

TABLE 4

| Viscosity Improver 4 and 5 in Solubilizers | | | VI 4 | | VI 5 | |
|---|---|---|---|---|---|---|
| | Property | Neat | 4A 1% | 4B 5% | 5A 1% | 5B 5% |
| DCR 1 | Compatibility | Clear | Clear | Clear | Clear | Clear |
| | Kinematic Viscosity 40° C. (cSt) | 21.0 | 67.9 | 1672.9 | 60.5 | 1411.8 |
| | Kinematic Viscosity 100° C. (cSt) | 2.9 | 9 | 210.8 | 8.1 | 135.1 |
| | Viscosity Index | −120.1 | 107.4 | 210.8 | 101.3 | 203.1 |
| DCR 2 | Compatibility | Clear | — | Clear | — | Clear |
| | Kinematic Viscosity 40° C. (cSt) | 15.7 | — | 1222.8 | — | 1203 |
| | Kinematic Viscosity 100° C. (cSt) | 2.9 | — | 141.9 | — | 138.6 |
| | Viscosity Index | −26.8 | — | 228.7 | — | 226.5 |
| Paraffinic oil | Compatibility | Clear | Clear | Clear | Clear | Clear |
| | Kinematic Viscosity 40° C. (cSt) | 38.2 | 88.1 | 1986.6 | 147.3 | 1309.4 |
| | Kinematic Viscosity 100° C. (cSt) | 6.2 | 13.2 | 196.8 | 20.9 | 143.9 |
| | Viscosity Index | 108.6 | 149.8 | 227.1 | 166 | 222.6 |
| Naphthenic oil | Compatibility | Clear | Clear | Clear | Clear | Clear |
| | Kinematic Viscosity 40° C. (cSt) | 20.8 | 51 | 1188.7 | 129.2 | 1001.6 |
| | Kinematic Viscosity 100° C. (cSt) | 3.7 | 8.2 | 122.5 | 47.9 | 116.6 |
| | Viscosity Index | 21 | 134 | 220 | 127.2 | 218.9 |
| Polyalphaolefin | Compatibility | Clear | Clear | Insoluble | Clear | Insoluble |
| | Kinematic Viscosity 40° C. (cSt) | 387.3 | 1242.7 | Insoluble | 532.6 | Insoluble |
| | Kinematic Viscosity 100° C. (cSt) | 39.7 | 58.3 | Insoluble | 53.9 | Insoluble |
| | Viscosity Index | 152.4 | 96.8 | Insoluble | 165.1 | Insoluble |
| Alkylated Naphthalene | Compatibility | Clear | Clear | Clear | Clear | Clear |
| | Kinematic Viscosity 40° C. (cSt) | 191 | 342.9 | 5582.3 | 362.4 | 3577 |
| | Kinematic Viscosity 100° C. (cSt) | 19 | 33.2 | 383.3 | 35.6 | 256.9 |
| | Viscosity Index | 112.6 | 137.5 | 225.4 | 142.2 | 207 |

Examples 6A-6C were prepared with the same solubilizers, but with Viscosity Improver 6 in amounts as indicated in Table 5.

TABLE 5

| Viscosity Improver 6 in Solubilizers | | | Viscosity Improver | | |
|---|---|---|---|---|---|
| | Property | Neat (0 wt. % VI) | 6A 1 wt. % | 6B 2.5 wt. % | 6C 5 wt. % |
| DCR | Compatibility | Clear | Clear | Clear | Clear |
| | Kinematic Viscosity 40° C. (cSt) | 21.0 | 35.2 | 33.1 | 48.5 |
| | Kinematic Viscosity 100° C. (cSt) | 2.9 | 5.0 | 4.9 | 7.3 |
| | Viscosity Index | −120.1 | 44.4 | 47.4 | 110.2 |
| Paraffinic oil | Compatibility | Clear | Clear | Clear | Clear |
| | Kinematic Viscosity 40° C. (cSt) | 38.2 | 41.2 | 44.0 | 52.6 |
| | Kinematic Viscosity 100° C. (cSt) | 6.2 | 6.8 | 8 | 9.7 |

TABLE 5-continued

| Viscosity Improver 6 in Solubilizers | | | | | |
|---|---|---|---|---|---|
| | | | Viscosity Improver | | |
| | Property | Neat (0 wt. % VI) | 6A 1 wt. % | 6B 2.5 wt. % | 6C 5 wt. % |
| | Viscosity Index | 108.6 | 119.5 | 145 | 171.2 |
| Naphthenic oil | Compatibility | Clear | Clear | Clear | Clear |
| | Kinematic Viscosity 40° C. (cSt) | 20.8 | 25.9 | 30.0 | 39.1 |
| | Kinematic Viscosity 100° C. (cSt) | 3.7 | 4.5 | 5.4 | 7.3 |
| | Viscosity Index | 21 | 74.7 | 116.4 | 155.3 |
| Polyalphaolefin | Compatibility | Clear | Clear | Insoluble | Insoluble |
| | Kinematic Viscosity 40° C. (cSt) | 387.3 | 390.2 | Insoluble | Insoluble |
| | Kinematic Viscosity 100° C. (cSt) | 39.7 | 40.1 | Insoluble | Insoluble |
| | Viscosity Index | 152.4 | 153.2 | Insoluble | Insoluble |
| Alkylated | Compatibility | Clear | Clear | Clear | Clear |
| Naphthalene | Kinematic Viscosity 40° C. (cSt) | 191 | 202.5 | 214.3 | 247 |
| | Kinematic Viscosity 100° C. (cSt) | 19.0 | 20.8 | 22.9 | 27.5 |
| | Viscosity Index | 112.6 | 121.4 | 130.6 | 145.5 |

Examples 7A-7C were prepared with the same solubilizers, but with Viscosity Improver 7 in amounts as indicated in Table 6.

TABLE 6

| Viscosity Improver 7 in Solubilizers | | | | | |
|---|---|---|---|---|---|
| | | | Viscosity Improver 7 | | |
| | Property | Neat (0 wt. % VI) | 7A 1 wt. % | 7B 2.5 wt. % | 7C 5 wt. % |
| DCR | Compatibility | Clear | Clear | Clear | Clear |
| | Kinematic Viscosity 40° C. (cSt) | 21.0 | 29.1 | 30.1 | 42.2 |
| | Kinematic Viscosity 100° C. (cSt) | 2.9 | 3.6 | 4.2 | 5.6 |
| | Viscosity Index | −120.1 | −91.4 | −32.5 | 55.3 |
| Paraffinic oil | Compatibility | Clear | Clear | Clear | Clear |
| | Kinematic Viscosity 40° C. (cSt) | 38.2 | 43 | 49.9 | 62.3 |
| | Kinematic Viscosity 100° C. (cSt) | 6.2 | 6.8 | 7.8 | 9.3 |
| | Viscosity Index | 108.6 | 114.5 | 121.7 | 128.4 |
| Naphthenic oil | Compatibility | Clear | Clear | Clear | Clear |
| | Kinematic Viscosity 40° C. (cSt) | 20.8 | 23.5 | 27.8 | 38.6 |
| | Kinematic Viscosity 100° C. (cSt) | 3.7 | 4.1 | 4.6 | 6.1 |
| | Viscosity Index | 21 | 40.5 | 70.5 | 103 |
| Polyalphaolefin | Compatibility | Clear | Clear | Clear | Clear |
| | Kinematic Viscosity 40° C. (cSt) | 387.3 | 420.8 | 438.6 | 497.4 |
| | Kinematic Viscosity 100° C. (cSt) | 39.7 | 43 | 44.4 | 49.3 |
| | Viscosity Index | 152.4 | 155.8 | 156 | 158.6 |
| Alkylated | Compatibility | Clear | Clear | Clear | Clear |
| Naphthalene | Kinematic Viscosity 40° C. (cSt) | 191 | 204.6 | 224.4 | 272.2 |
| | Kinematic Viscosity 100° C. (cSt) | 19.0 | 20.5 | 22.2 | 26.1 |
| | Viscosity Index | 112.6 | 116.7 | 119.7 | 124.8 |

The following components were used to make engine oil formulations.

Base stock 1 is a low viscosity polyalphaolefin with a viscosity index of 126, according to ASTM D2270.

Base stock 2 is a polyol ester category Group V fluid with a viscosity index of 130, according to ASTM D2270.

Base stock 3 is alkylate naphthalene with a viscosity index of 74, according to ASTM D2270.

DCR is the DCR described above.

AP1 is Lubrizol 1510 PCMO, an additive package for use in engine oils meeting GF-6 specifications VIC 1 is Viscosity Improver 1 described above.

AP2 is HiTEC® 11183, upgraded additive package for use in engine oils meeting both the ILSAC GF-6 specification and GM dexos 1 Gen 3.

Engine oil formulations using the viscosity improver concentrate were made on a hot plate with magnetic stirring at 80-100° C. Base stock 1-3 was mixed together first (if indicated). The viscosity improver concentrate was added to the base stock mixture and mixed until combined/homogeneous. Finally, the additive package was added and mixed until combined/homogeneous.

The engine oil formulations were tested for density and compatibility as outlined above. These results are in Table 5.

TABLE 5

| Engine Oil Formulations | | | |
|---|---|---|---|
| | Engine Oil 1 | Engine Oil 2 wt.% | Engine Oil 3 |
| Base Stock 1 | 70 | 70 | 70 |
| Base Stock 2 | 7.5 | — | — |
| Base Stock 3 | — | — | 7.5 |
| DCR | 7.5 | 15 | 7.5 |

TABLE 5-continued

| Engine Oil Formulations | | | |
|---|---|---|---|
| | Engine Oil 1 | Engine Oil 2 wt.% | Engine Oil 3 |
| AP1 | 10 | 10 | 10 |
| VIC 1 | 5 | 5 | 5 |
| Total | 100 | 100 | 100 |
| Appearance | Clear | Clear | Clear |
| Viscosity index | 153.7 | 148.1 | 150.5 |

TABLE 6

| Engine Oil Formulations | | | |
|---|---|---|---|
| | Engine Oil 4 | Engine Oil 5 wt. % | Engine Oil 6 |
| Base Stock 1 | 70 | 70 | 70 |
| Base Stock 2 | 7.5 | — | — |
| Base Stock 3 | — | — | 7.5 |
| DCR | 7.5 | 15 | 7.5 |
| AP 2 | 10 | 10 | 10 |
| VIC 1 | 5 | 5 | 5 |
| Total | 100 | 100 | 100 |
| Appearance | Clear | Clear | Clear |
| Viscosity index | 143.5 | 135.3 | 136.8 |

As used herein, the term "comprising" means including elements or steps that are identified following that term, but any such elements or steps are not exhaustive, and an embodiment can include other elements or steps. Although the terms "comprising" and "including" have been used herein to describe various aspects, the terms "consisting essentially of" and "consisting of" can be used in place of "comprising" and "including" to provide for more specific aspects of the disclosure and are also disclosed.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

Unless otherwise specified, all technical and scientific terms used herein have the same meanings as commonly understood by one of skill in the art to which the disclosed disclosure belongs. The recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A viscosity modifier concentrate comprising:

0.01-10 wt. % of a viscosity index improver;

90-99.9 wt. % of a solubilizer comprising a decarboxylated rosin acid; and wherein the decarboxylated rosin acid has at least one of:

one or more C═C groups, and 40-100 wt. % of tricyclic compounds having 18-20 carbon atoms;

a sum of tricyclic compounds as aromatic and cycloaliphatic of 50-100 wt. %, based on total weight of the decarboxylated rosin acid; and an amount of cycloaliphatic compounds of 15-100 wt. %, based on total weight of the decarboxylated rosin acid; and 0-35.0 wt. % additives;

wherein the decarboxylated rosin acid solubilizes the viscosity index improver in less than 3 hours at a temperature of 120° C.

2. The viscosity modifier concentrate of claim 1, wherein the decarboxylated rosin acid has at least one of:

a density of 0.9 to 1.0 g/cm$^3$ at 20° C.;

an acid value of <50 mg KOH/g, according to ASTM D1240-14;

an aniline point of 3-40° C., according to ASTM D611;

a pour point of −40 to +10° C., according to ASTM D97;

a flash point of 95-175° C., according to ASTM D92;

a boiling point of 200-390° C., according to D2887;

a Gardner Color of 0-12.0, according to ASTM D6166;

a sulfur content of <500 ppm, according to ASTM D5453;

a Kb (Kauri butanol) value of 25-90, according to ASTM D1133;

a viscosity index of >−200, according to ASTM D2270;

a viscosity of 15-60 cSt, according to ASTM D-445 at 40° C.;

a thermal conductivity of about <0.3, according to ASTM D4308;

a dielectric constant of <5, according to ASTM D924;

a specific heat capacity of 1475-1800, according to ASTM E1269;

an electrical conductivity of <3 Ps/m, according to ASTM D4308; and a Power Factor at 100° C. of 0.01-3, according to ASTM D924.

3. The viscosity modifier concentrate of claim 1, wherein the decarboxylated rosin acid is unhydrogenated, and wherein the unhydrogenated decarboxylated rosin acid has at least one of:

a C19 species with a MW of 262 in an amount of 5-20 wt. %;

a C19 species with a MW of 260 in an amount of 5-25 wt. %;

a C19 species with a MW of 256 in an amount of 35-55 wt. %;

a C19 species with a MW of 252 in an amount of 5-20 wt. %;

a C13 species with a MW of 180 in an amount of 0-5 wt. %; and a C13 species with a MW of 174 in an amount of 5-25 wt. %.

4. The viscosity modifier concentrate of claim 3, wherein the unhydrogenated decarboxylated rosin acid has at least one of:

a flash point of 135-175° C., according to ASTM D92; and a Kb (Kauri butanol) value of 25-90, according to ASTM D1133.

5. The viscosity modifier concentrate of claim 1, wherein the decarboxylated rosin acid is hydrogenated, and wherein the hydrogenated decarboxylated rosin acid has at least one of:

a C19 species with a MW of 262 in an amount of 25-100 wt. %;

a C19 species with a MW of 260 in an amount of 0-5 wt. %;

a C19 species with a MW of 256 in an amount of 0-40 wt. %;

a C19 species with a MW of 252 in an amount of 0-5 wt. %;

a C13 species with a MW of 180 in an amount of 0-20 wt. %; and a C13 species with a MW of 174 in an amount of 0-5 wt. %.

6. The viscosity modifier concentrate of claim 5, wherein the hydrogenated decarboxylated rosin acid has at least one of:

a pour point of-40 to-10° C., according to ASTM D97;

a flash point of 95-140° C., according to ASTM D92;

a viscosity index of-50 to 0, according to ASTM D2270;

a Gardner Color of <1, according to ASTM D6166;

a sulfur content of 0.001-10 ppm, according to ASTM D5453; and an acid value of <1 mg KOH/g, according to ASTM D1240-14 (2018) or ASTM D465.

7. The viscosity modifier concentrate of claim 1, wherein the viscosity index improver is selected from the group consisting of hydrogenated styrene-butadiene rubbers, ethylene-propylene copolymers, ethylene copolymers with propylene and olefins, polymethacrylates, polyacrylates, hydrogenated styrene-isoprene polymers, hydrogenated diene polymers, polyalkyl styrenes, polyolefins, esters of maleic anhydride-olefin copolymers, esters of maleic anhydride-styrene copolymers, and mixtures thereof.

8. The viscosity modifier concentrate of claim 1, the viscosity index improver is a styrenic block copolymer having a general configuration of A-B, A-B-A, B-A-B, A-B-A-B, A-B-A-B-A, (A-B)n, (A-B)n(A), (A-B-A)n, (A-B-A)nX, (A-B)nX, (B-A-B)nX, (A-B-A-B)nX, (A-B-A-B-A)nX, A'-B, A'-B-A, A-B-A', A'-B-A', B-A'-B, A'-B-A-B, A-B-A'-B, A'-B-A'-B, A'-B-A-B-A, A-B-A'-B-A, A-B-A-B-A', A'-B-A'-B-A, A-B-A'-B-A', (A'-B)n, (A-B)n(A'), (A'-B)n(A), (A'-B)n(A'), (A'-B-A)n, (A-B-A')n, (A'-B-A')n, (A'-B-A)nX, (A-B-A')nX, (A'-B-A')nX, (A'-B)nX, (B-A'-B)nX, (A'-B-A-B)nX, (A-B-A'-B)nX, (A'-B-A'-B)nX, (A'-B-A-B-A)nX, (A-B-A'-B-A)nX, (A-B-A-B-A')nX, (A'-B-A'-B-A)nX, (A-B-A'-B-A')nX, A-B', A-B'-A, B'-A-B, B-A-B', B'-A-B', A-B'-A-B, A-B-A-B', A-B'-A-B', A-B'-A-B-A, A-B-A-B'-A, A-B'-A-B'-A, (A-B')n, (A-B')n(A), (A-B'-A)n, (A-B'-A)nX, (A-B')nX, (B'-A-B)nX, (B-A-B')nX, (B'-A-B')nX, (A-B'-A-B)nX, (A-B-A-B')nX, (A-B'-A-B')nX, (A-B'-A-B-A)nX, (A-B-A-B'-A)nX, (A-B'-A-B'-A)nX, A'-B', A'-B'-A', B'-A'-B', A'-B'-A'-B', A'-B'-A'-B'-A', (A'-B')n, (A'-B')n(A'), (A'-B'-A')n, (A'-B'-A')nX, (A'-B')nX, (B'-A'-B')nX, (A'-B'-A'-B')nX, (A'-B'-A'-B'-A')nX, or mixtures thereof; where n is an integer from 2 to 30; and X is a residue of a coupling agent;

wherein:

each block A and A' is same or different and independently a polymer block of vinyl aromatic monomer, each block B is independently a polymer block of a conjugated diene monomer or a mixture of 2 or more conjugated diene monomers, and each B' consists of at least one vinyl aromatic monomer and conjugated diene monomer.

9. A method of forming a viscosity modifier concentrate, the method comprising:

providing 0.01-10wt. % of a viscosity index improver;

providing 90-99.9 wt. % of a solubilizer comprising a decarboxylated rosin acid, wherein the decarboxylated rosin acid has at least one of:

one or more C-C groups, and 40-100 wt. % of tricyclic compounds having 18-20 carbon atoms;

a sum of tricyclic compounds as aromatic and cycloaliphatic of 50-100 wt. %, based on total weight of the decarboxylated rosin acid; and an amount of cycloaliphatic compounds of 15-100 wt. %, based on total weight of the decarboxylated rosin acid;

providing 0-35 wt. % of optional additives; and contacting the viscosity modifier and the solubilizer to form the viscosity modifier concentrate;

wherein the decarboxylated rosin acid solubilizes the viscosity index improver in less than 3 hours at a temperature of 120° C.

10. The method of claim 9, wherein the decarboxylated rosin acid has at least one of:

a density of 0.9 to 1.0 g/cm3 at 20° C.;

an acid value of <50 mg KOH/g, according to ASTM D1240-14;

an aniline point of 3-40° C., according to ASTM D611;

a pour point of −40 to +10° C., according to ASTM D97;

a flash point of 95-175° C., according to ASTM D92;

a boiling point of 200-390° C., according to D2887;

a Gardner Color of 0-12.0, according to ASTM D6166;

a sulfur content of <500 ppm, according to ASTM D5453;

a Kb (Kauri butanol) value of 25-90, according to ASTM D1133;

a viscosity index of >-200, according to ASTM D2270;

a viscosity of 15-60 cSt, according to ASTM D-445 at 40° C.;

a thermal conductivity of about <0.3, according to ASTM D4308;

a dielectric constant of <5, according to ASTM D924;

a specific heat capacity of 1475-1800, according to ASTM E1269;

an electrical conductivity of <3 Ps/m, according to ASTM D4308; and a Power Factor at 100° C. of 0.01-3, according to ASTM D924.

11. The method of claim 9, wherein the decarboxylated rosin acid is unhydrogenated, and wherein the unhydrogenated decarboxylated rosin acid has at least one of:

a C19 species with a MW of 262 in an amount of 5-20 wt. %;

a C19 species with a MW of 260 in an amount of 5-25 wt. %;

a C19 species with a MW of 256 in an amount of 35-55 wt. %;

a C19 species with a MW of 252 in an amount of 5-20 wt. %;

a C13 species with a MW of 180 in an amount of 0-5 wt. %; and a C13 species with a MW of 174 in an amount of 5-25 wt. %.

12. The method of claim 11, wherein the unhydrogenated decarboxylated rosin acid has at least one of:

a flash point of 135-175° C., according to ASTM D92; and a Kb (Kauri butanol) value of 25-90, according to ASTM D1133.

13. The method of claim 9, wherein the decarboxylated rosin acid is hydrogenated, and wherein the hydrogenated decarboxylated rosin acid has at least one of:

a C19 species with a MW of 262 in an amount of 25-100 wt. %;

a C19 species with a MW of 260 in an amount of 0-5 wt. %;

a C19 species with a MW of 256 in an amount of 0-40 wt. %;

a C19 species with a MW of 252 in an amount of 0-5 wt. %;

a C13 species with a MW of 180 in an amount of 0-20 wt. %; and a C13 species with a MW of 174 in an amount of 0-5 wt. %.

14. The method of claim 13, wherein the hydrogenated decarboxylated rosin acid has at least one of:

a pour point of −40 to -10° C., according to ASTM D97;

a flash point of 95-140°° C., according to ASTM D92;

a viscosity index of <25, according to ASTM D2270;

a Gardner Color of <1, according to ASTM D6166;

a sulfur content of 0.001-10 ppm, according to ASTM D5453; and an acid value of <1 mg KOH/g, according to ASTM D1240-14 (2018) or ASTM D465.

15. The method of claim 9, wherein the viscosity index improver is selected from the group consisting of hydrogenated styrene-butadiene rubbers, ethylene-propylene copolymers, ethylene copolymers with propylene and olefins, polymethacrylates, polyacrylates, hydrogenated styrene-isoprene polymers, hydrogenated diene polymers, polyalkyl styrenes, polyolefins, esters of maleic anhydride-olefin copolymers, esters of maleic anhydride-styrene copolymers, and mixtures thereof.

16. The method of claim 9, the viscosity index improver is a styrenic block copolymer having a general configuration of A-B, A-B-A, B-A-B, A-B-A-B, A-B-A-B-A, (A-B)n, (A-B)n (A), (A-B-A)n, (A-B-A)nX, (A-B)nX, (B-A-B)nX, (A-B-A-B)nX, (A-B-A-B-A)nX, A'-B, A'-B-A, A-B-A', A'-B-A', B-A'-B, A'-B-A-B, A-B-A'-B, A'-B-A'-B, A'-B-A-B-A, A-B-A'-B-A, A-B-A-B-A', A'-B-A'-B-A, A-B-A'-B-A', (A'-B)n, (A-B)n(A'), (A'-B)n(A), (A'-B)n(A'), (A'-B-A)n, (A-B-A')n, (A'-B-A')n, (A'-B-A)nX, (A-B-A')nX, (A'-B-A')nX, (A'-B)nX, (B-A'-B)nX, (A'-B-A-B)nX, (A-B-A'-B)nX, (A'-B-A'-B)nX, (A'-B-A-B-A)nX, (A-B-A'-B-A)nX, (A-B-A-B-A')nX, (A'-B-A'-B-A)nX, (A-B-A'-B-A')nX, A-B', A-B'-A, B'-A-B, B-A-B', B'-A-B', A-B'-A-B, A-B-A-B', A-B'-A-B', A-B'-A-B-A, A-B-A-B'-A, A-B'-A-B'-A, (A-B')n, (A-B')n(A), (A-B'-A)n, (A-B'-A)nX, (A-B')nX, (B'-A-B)nX, (B-A-B')nX, (B'-A-B')nX, (A-B'-A-B)nX, (A-B-A-B')nX, (A-B'-A-B')nX, (A-B'-A-B-A)nX, (A-B-A-B'-A)nX, (A-B'-A-B'-A)nX, A'-B', A'-B'-A', B'-A'-B', A'-B'-A'-B', A'-B'-A'-B'-A', (A'-B')n, (A'-B')n(A'), (A'-B'-A')n, (A'-B'-A')nX, (A'-B')nX, (B'-A'-B')nX, (A'-B'-A'-B')nX, (A'-B'-A'-B'-A')nX, or mixtures thereof; where n is an integer from 2 to 30; and X is a residue of a coupling agent;

wherein:

each block A and A' is same or different and independently a polymer block of vinyl aromatic monomer, each block B is independently a polymer block of a conjugated diene monomer or a mixture of 2 or more conjugated diene monomers, and each B' consists of at least one vinyl aromatic monomer and conjugated diene monomer.

17. A lubricating oil composition comprising the viscosity index improver concentrate of claim 1.

* * * * *